US005964393A

United States Patent [19]

Feldpausch et al.

[11] Patent Number: 5,964,393

[45] Date of Patent: Oct. 12, 1999

[54] RIVET FEED APPARATUS

[75] Inventors: Michael Feldpausch, Hochstein 1, D-5-8849, Herscheid, Germany; Stuart Edmund Blacket, Closeburn, Australia

[73] Assignee: Michael Feldpausch, Herscheid, Germany

[21] Appl. No.: 08/765,359

[22] PCT Filed: Jul. 4, 1995

[86] PCT No.: PCT/EP95/02580

§ 371 Date: Mar. 19, 1997

§ 102(e) Date: Mar. 19, 1997

[87] PCT Pub. No.: WO96/01161

PCT Pub. Date: Jan. 18, 1996

[30] Foreign Application Priority Data

Jul. 4, 1994 [DE] Germany ..... 44 23 165

[51] Int. Cl.[6] ..... B25C 5/13

[52] U.S. Cl. ..... 227/135; 227/139

[58] Field of Search ..... 227/135, 137, 227/112, 139

[56] References Cited

U.S. PATENT DOCUMENTS

| | | | |
|---|---|---|---|
| 1,730,750 | 10/1929 | Stimpson . | |
| 2,790,971 | 5/1957 | Hlobil | 227/137 |
| 3,040,924 | 6/1962 | Johnson | 227/139 |
| 3,700,139 | 10/1972 | Kelly . | |
| 4,044,462 | 8/1977 | Anseimo . | |
| 4,252,260 | 2/1981 | Burton | 227/139 |
| 4,404,742 | 9/1983 | Fuhrmeister | 227/112 |
| 4,577,794 | 3/1986 | Armstrong et al. . | |
| 4,609,134 | 9/1986 | Davern . | |
| 4,643,344 | 2/1987 | Kaita et al. | 227/112 |
| 4,765,175 | 8/1988 | Denham et al. | 227/112 |
| 5,004,141 | 4/1991 | Young et al. | 227/112 |
| 5,104,024 | 4/1992 | Brewer et al. | 227/135 |
| 5,110,029 | 5/1992 | Blake | 227/112 |
| 5,236,341 | 8/1993 | Stafford | 227/112 |
| 5,398,860 | 3/1995 | Edwards . | |
| 5,427,297 | 6/1995 | Tymianski | 227/135 |
| 5,465,868 | 11/1995 | Bonomi | 227/135 |
| 5,779,127 | 7/1998 | Blacket et al. | 227/112 |

FOREIGN PATENT DOCUMENTS

| | | |
|---|---|---|
| 3631657 | 4/1987 | Germany . |
| WO 94/15736 | 7/1994 | WIPO . |

*Primary Examiner*—Jessica J. Harrison
*Assistant Examiner*—John Paradiso
*Attorney, Agent, or Firm*—Jacobson, Price, Holman & Stern PLLC

[57] ABSTRACT

An apparatus for setting up fastener elements having a shaft and a head, e.g. rivets or the like, wherein the shaft length is equal to or less than the head diameter, the setting-up being ahead of a press-bar or hammer of a fastener-driving machine, which press-bar or hammer is adjusted to the head of the fastener elements. The apparatus includes a transfer mechanism which transports fastener elements in succession, by means of a flow of a medium, into an intermediate position in the vicinity of the press-bar or hammer. A radially elastic holding device is disposed in the fastener-driving machine, which holding device is movable with the press-bar or hammer and is capable of holding the head in an axial orientation with respect to the press-bar or hammer at a location ahead of the press-bar or hammer, i.e. downstream in the flow of driving force exerted by the press-bar or hammer. The transfer mechanism transfers a transported fastener element to and into the holding device.

35 Claims, 11 Drawing Sheets

215
218
217
251
211
264
240
232
262
285
16
288
241
243
292
267
266
216
268
270
275
274
276
277
272
278
294
296
290
292
207
202
208
228
237
259
226
222
257
255
258
260
224
d
d
16

RIVET FEED APPARATUS

BACKGROUND OF THE INVENTION

1. Field of the Invention

The invention relates to an apparatus for setting up rivets having a shaft and a head, or similar fasteners, wherein, in particular, the shaft length is equal to or less than the head diameter, ahead of a press-bar or hammer of a fastener-driving machine. The press-bar is adjusted to the head of the fasteners. The apparatus comprises a transfer mechanism which conveys individual fasteners, with the aid of a flowing medium, to a position near the press-bar, which position is intermediate between the press-bar and the workpiece(s) to be fastened.

2. Description of the Related Art

In U.S. Pat. No. 1,730,750 a fastener-driving machine is described which has two parallel upwardly directed rails which deliver fasteners ahead of a press-bar. The heads of the fasteners can glide over the rails, with the shafts of the fasteners hanging in the gap separating the rails. The fastener-driving machine has a holding mechanism mounted to it at the delivery location of the rails in such a way that the head of the forwardmost fastener among the fasteners being conveyed on the rails is gripped from below by two laterally elastic fingers separated at a distance of the shaft diameter, which fingers are oriented toward the press-bar, in the direction of the axis of said press-bar. A disadvantage of this arrangement is that the fasteners are fed by gravity, which results in appreciable imprecision in the axial orientation of the fastener being held in readiness ahead of the press-bar.

In Ger. DE-A-36 31 657 an apparatus is described which is intended for setting up fasteners, wherein individual fasteners are conveyed through a tube by means of pressurized air, into an intermediate position near the press-bar. Each rivet thus conveyed is then transferred from this intermediate position to a position in the driving path of the press-bar, by means of a sliding carrier which can be moved transversely to the driving direction. This solution is disadvantageous in that, particularly where the fastener is a top-heavy body with shaft length equal to or less than head diameter, the apparatus does not reliably orient the fastener in the axial direction. In order for the fastener to be oriented substantially in alignment with the press-bar, a shaft of a certain length is required, so that the shaft will be securely and reliably gripped when the fastener is in the above-mentioned intermediate position. A further disadvantage is that due to the feeding of the fastener into the intermediate position, the down-holding device of the driving mechanism must be kept relatively wide in its dimension transverse to the driving direction, which causes difficulty in using the apparatus to drive fasteners into workpieces having any appreciable three-dimensional contour.

Eur. EP-A-567,240 discloses means of setting up individual fasteners ahead of a press-bar by means of a belt which is passed transversely through the driving machine, wherein a row of identically oriented fasteners is fixed on (or in) said belt. This enables one to align a fastener axially ahead of and with respect to the press-bar, in an accurate and reliable fashion. However, the belt must be disposed of after it delivers all of the fasteners which it bears, and this introduces substantial costs.

SUMMARY OF THE INVENTION

Accordingly, the object of the present invention is to devise a means of reliable and accurate orientation of individual fasteners in their condition of being set up ahead of the press-bar or hammer, in an apparatus of the general type described initially supra, wherein in particular, the inventive means is effective for the described top-heavy fasteners.

This object is achieved according to the invention in that, in an apparatus of the aforesaid general type, the driving machine is provided with a radially elastic holding device which can be moved along with the press-bar, which holding device can hold the head of the fastener in an orientation directed axially toward the press-bar, at a position immediately ahead of the press-bar and in that the transfer mechanism is provided with means for delivering a supplied fastener into the holding device. In this way the fastener is properly oriented by means of the holding device and does not lose its orientation prior to being driven into the workpiece, because the holding device is moved along with the press-bar. Accordingly, the transfer mechanism itself does not need to meet any stringent accuracy requirements. This allows flexibility in designing the transfer mechanism for the following features: non-interference with the driving process in the case of, e.g., a sheet metal workpiece having high curvature; and, capability of handling rivets having a very short shaft.

According to a preferred embodiment of the invention, the transfer means can take a fastener being transported in the intermediate position and insert it into the holding device from a position below the holding device, i.e. in a direction of insertion which is opposite to the driving direction. For example, if the transfer means comprises a swing arm wherein the supplied fastener is disposed in its intermediate position on said swing arm, then when the swing arm is swung into the driving path, the swing arm need only be moved through a small axial excursion in order to insert the fastener into the holding device.

With another embodiment of the invention, a fastener is held temporarily in an intermediate position ahead of the press-bar, and is then transferred to the holding device after the driving process is underway.

A ring of spheres is recommended as the holding device, wherein the spheres are radially elastically held in a tip piece of the fastener-driving machine, which piece surrounds the press-bar. When the driving process occurs, the holding device moves along with the press-bar, in the driving direction.

DETAILED DESCRIPTION OF THE PREFERRED EMBODIMENTS

Figure 3:
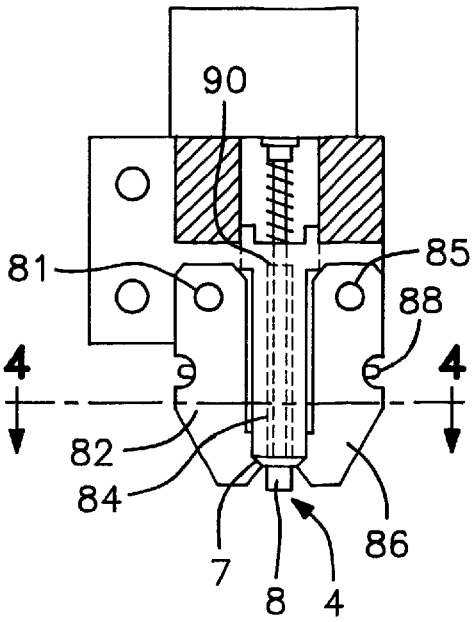
FIG. 3 is a view of the receiving station along line III—III of FIG. 2.

The riveting apparatus designated generally 10 serves, e.g., to fasten together two workpieces (not shown). The rivets are designated 1–6 in FIGS. 1–3. The length of the shaft 8 of a rivet is less than the diameter of its head 7.

The riveting apparatus 10 has a fixed crown 12 from which a reducing piece 14 can be lowered and raised back up through an excursion D. The reducing piece 14 bears a down-holding appliance 16 at its free lower end, which down-holder bears an elongated press-bar or hammer 18 disposed axially in its transverse center. The lower dead point of the down-holder 16 is indicated with dashed lines (16*a*) in FIG. 1.

A so-called C-frame 13 is affixed to the crown 12 of the riveting apparatus 10. The C-frame extends in a large arc from the crown 12 to a position below the lower dead point of the down-holder, and is there provided with a forming support 15 directed toward the down-holder 16 along the axis 17 thereof.

When two sheets to be riveted are placed on the forming support 15, an operating excursion of the down-holder 16 is initiated, whereupon the down-holder is moved to its lower dead point position 16*a,* whereupon an axial impulse is imparted to the press-bar 18 which drives a rivet into the workpieces to be riveted. Then the press-bar 18 and down-holder 16 are retracted to their upper rest positions.

Figure 1:
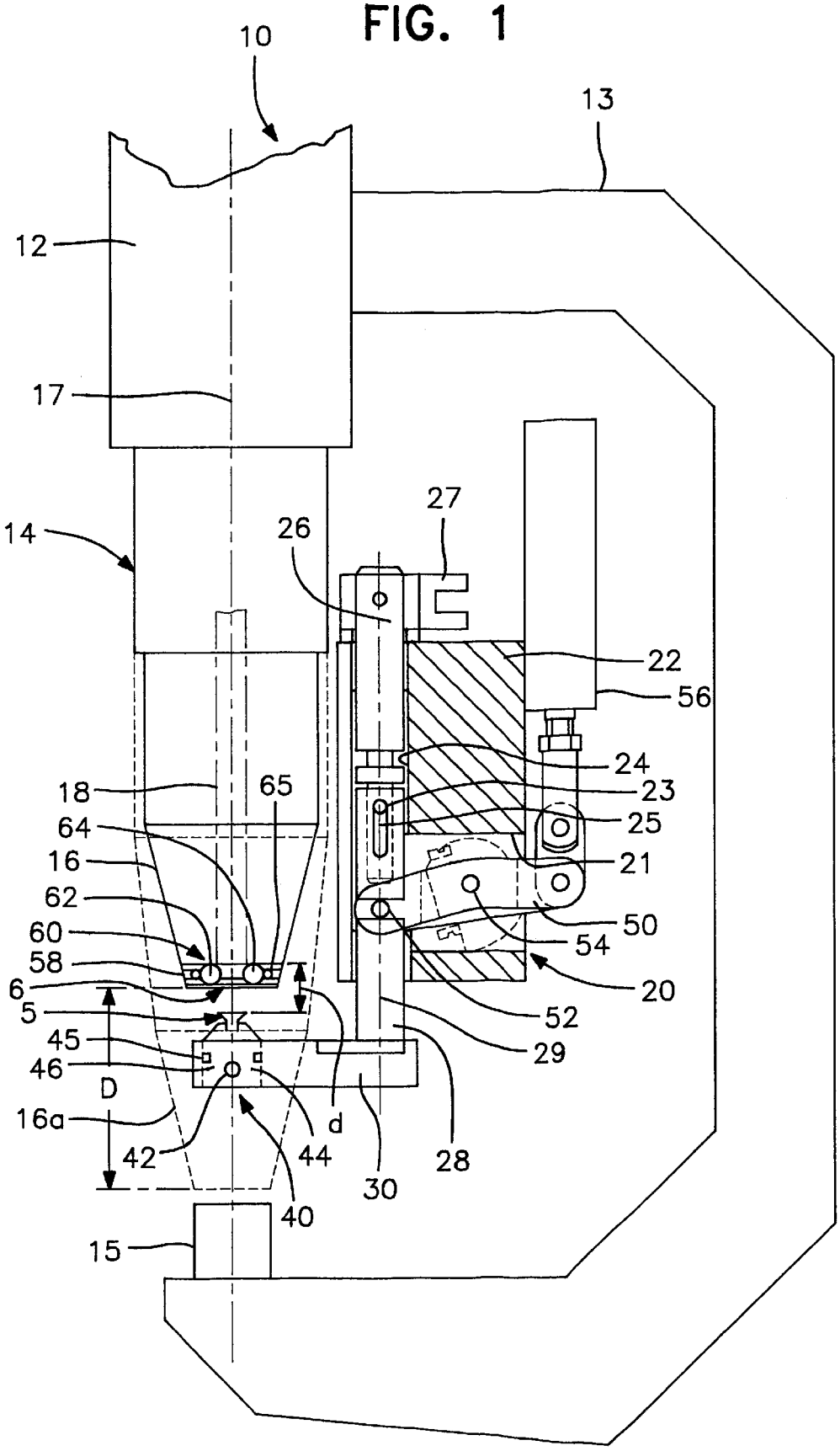
FIG. 1 is a partial cross sectional lateral view of an apparatus equipped with features of the invention.

A device with the overall designation 20 serves to set up the individual rivets to be driven by the press-bar. Setup device 20 (also referred to as the "transfer device") is mounted, e.g., on the crown 12, by means not shown. It consists of a solid block 22 having a throughgoing bore 24 parallel to the axis 17. A two-piece shaft (26, 28) is rotatable in bore 24 through a prescribed angle. A lever 27 extending transversely to the shaft axis is attached by key or wedge means to the segment of shaft piece 26 which segment extends upwardly out of the bore 24 and is held axially untranslatably in the bore 24. Lever 27 is movably connected (by means not shown) to the piston of a piston-and-cylinder unit which is positionally fixed i.e., e.g., to the frame 13. The narrower lower segment of shaft piece 26 penetrates into a bore in a part of the lower shaft piece 28, the shell of which piece 28 has a longitudinal slot 25 which extends axially for a distance at least equal to d (FIG. 1). A pin 23 fixed to shaft piece 26 engages slot 25. This engagement serves to transmit rotations of shaft piece 26 to shaft piece 28. At the same time, shaft piece 28 remains axially displaceable with respect to shaft piece 26 by a distance at least equal to d.

A swing arm 30 extending transversely to the axis 29 of the shaft 26, 28 is rotationally rigidly anchored to the lower end of shaft piece 28 which end projects from the bore 24. The free end of swing arm 30 bears a holding mechanism 40 for a rivet 5, which mechanism 40 is essentially comprised of two opposing gripping members 44, 46 swingable to a limited extent around a pivot 42. The gripping members are held mutually together by an O-ring 45 which is seated in grooves in said gripping members 44, 46 above the pivot 42. The upper free end of the gripping members defines a holding recess for the shaft 8 of a rivet 5, wherein the head 7 of the rivet 5 remains above the gripping members 44, 46. As may be seen in FIG. 1, the distance of the vertical center line of the intermediate holder 40 from the axis 29 is equal to the distance of axis 17 from axis 29. Thus the swing arm 30 is swingable around axis 29, between a delivery position shown in FIG. 1 and a receiving position shown in FIG. 2, by means of the above-mentioned piston-and-cylinder unit which engages the lever 27. In the delivery position the axis of the holder 40 is aligned with axis 17.

The non-bored segment of shaft piece 28, disposed in bore 24, has a groove in the circumferential direction; a pin 52 projecting from a two-armed lever 50, which lever is pivoted at 54 on block 22, radially engages said groove. The opposite end of lever 50, which projects outward from block 22, is pivotably linked to the piston of a piston-and-cylinder unit 56 mounted on block 22. As seen, the lever 50 extends through an opening 21 in block 22, which opening is wide enough to allow the lever 50 to swing essentially in a vertical plane, around pivot pin 54, when the cylinder unit 56 is actuated, thereby moving shaft piece 28 along axis 29 (corresponding to the movement of the lever 50).

Figure 2:
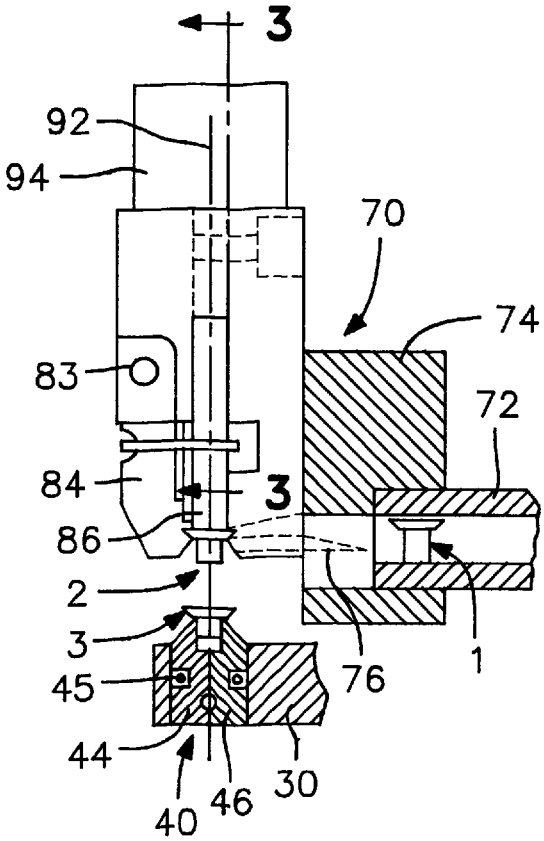
FIG. 2 is a partial cross sectional lateral view of the receiving station of the transfer mechanism of the apparatus according to FIG. 1.
Figure 4:
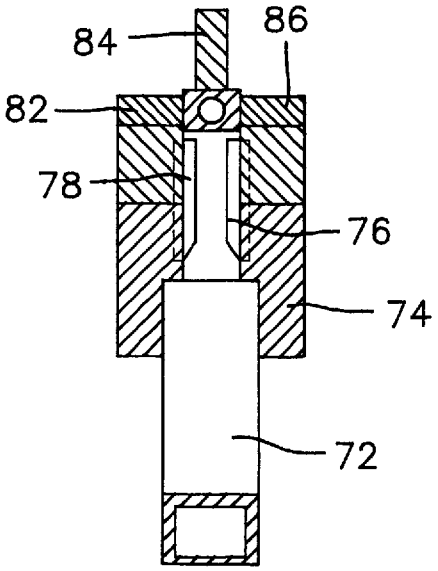
FIG. 4 is a cross sectional view of the receiving station along line IV—IV of FIG. 3.

According to FIG. 2, a plastic conveying tube 72 proceeding from the delivery end of a vibratory feed device (not shown) opens out at a receiving station 70.

A suitable vibratory feed device is described in Ger. Pat. 42 39 683; it is capable of delivering a series of rivets having like orientation from a reservoir of un-oriented rivets. The contents of said patent document are incorporated herein by reference. The cross section of the tube 72 is adjusted to the rivet configuration (see rivet 1, FIG. 2), wherein the rivets can be conveyed through tube 72 by compressed air without losing their orientation. For this purpose, tube 72 is given a rectangular cross section, with inside width only slightly wider than the diameter of the rivet head 7 and inside height only slightly higher than the length of the rivet, such that rivets passing through tube 72 cannot suffer tilting, wobbling or the like.

As shown in FIG. 2, the end of tube 72 is accommodated in a receiving block 74 bearing two opposing receiving strips 76, 78 at an altitude shortly below the head 7 of the arriving rivet. The gap between the receiving strips 76, 78 is wider than the diameter of the rivet shaft 8 but narrower than the diameter of the rivet head 7; consequently the rivets are deposited in a hanging orientation on the strips 76, 78 and are conveyed to a position between three claws 82, 84, 86 disposed at mutual 90° angles and at a common altitude, which claws pivot on respective upper pivot pins 81, 83, 85 and are held together by an O-ring 88 which is disposed in a groove below said pivot pins 81, 83, 85 and encircles said claws. Thus the claws 82, 84, 86 can be swung outward against the force of the O-ring 88. The rivet is held by the claws 82, 84, 86 by engagement below its head until it is liberated from their grip by being driven downward by a plunger 90 connected to drive means 94. The plunger 90 is vertically movable along a vertical axis 92 by said drive means. When plunger 90 is actuated, with the swing arm 30 in the holding position (FIG. 2), the central axis of the holder 40 is aligned flush with the axis 92. When plunger 90 presses downward on the head 7 of a rivet 2, the rivet is pressed downward out of the claw grip 82, 84, 86. The claws can yield outward by pivoting around the pins 81, 83, 85, whereby said plunger 90 presses the rivet (FIG. 2) shaft-first (with shaft 8 downward) into the holding mechanism 40 which has been moved to a point directly under the claws.

The down-holder 16 has a tip piece 58 which bears a holding device 60 for a rivet, which device is comprised of a ring of spheres 62, 64 held in a round cage by an O-ring 65 surrounding all of the spheres. Each sphere extends radially inward from the cage, with a forward cup-shaped spherical segment of said sphere; when (e.g.) a rivet head passes through the ring of spheres, the spheres can yield radially against the force of the O-ring 65 to enable such passage, following which the spheres move radially inward to rest against the rivet shaft. When the press-bar 18 drives a rivet 6 out, said bar 18 can also pass between the spheres 62, 64.

Figure 5:
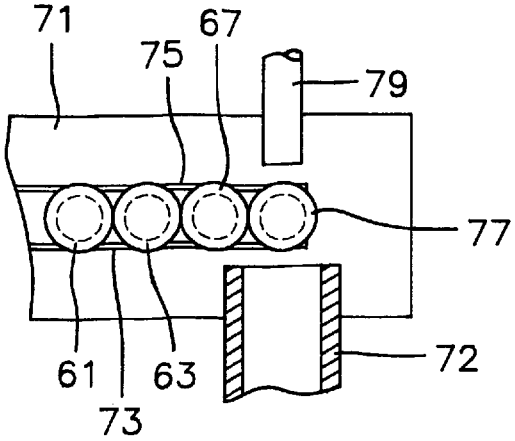
FIG. 5 is a schematic representation of a detail of FIG. 1.
Figure 17:
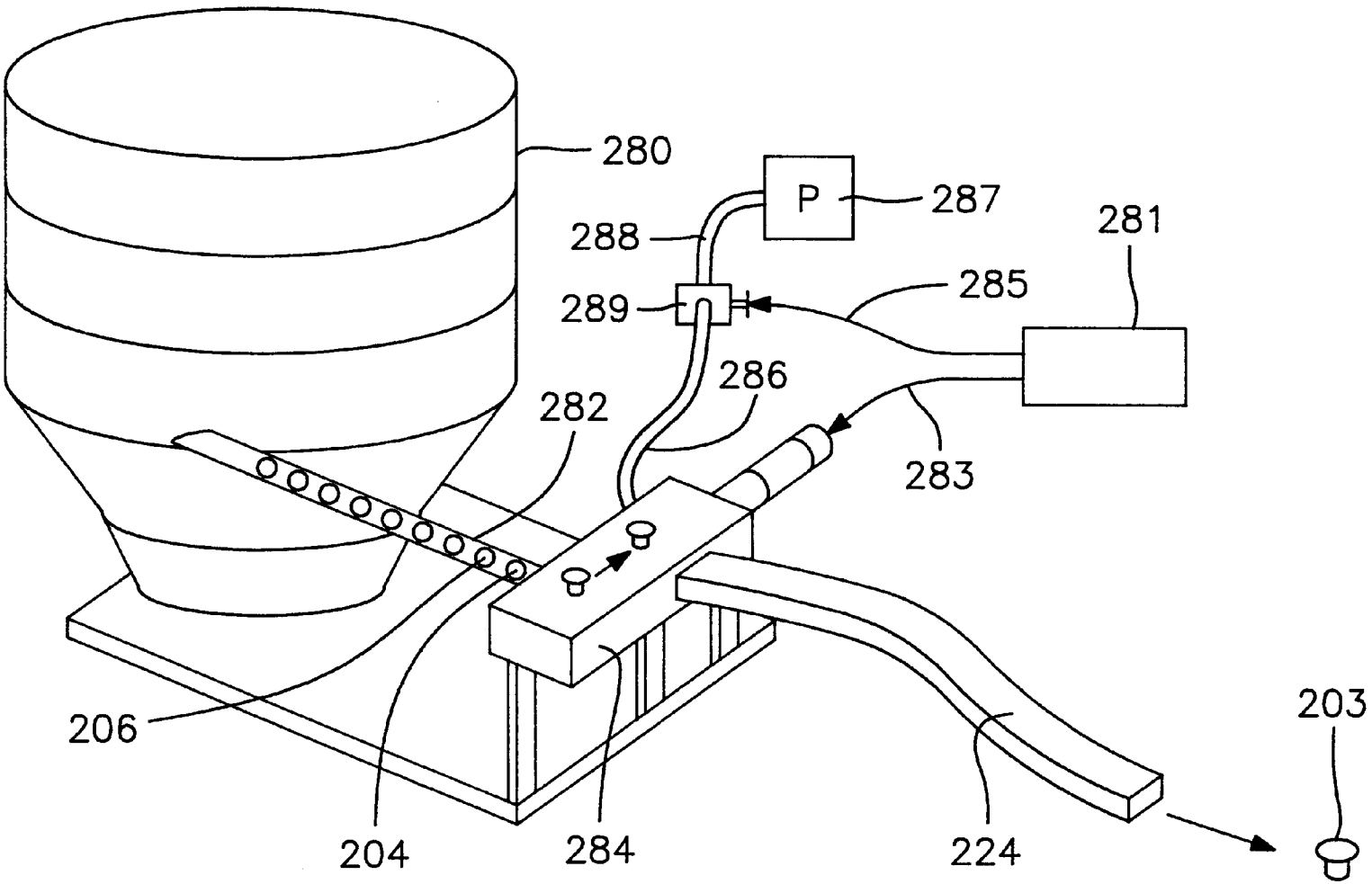
FIG. 17 is a schematic drawing to aid in elucidating the invention.

FIG. 5 shows schematically in a plan view a delivery element 71 of a vibratory feed device, bearing a row of rivets 61, 63, 67, 77 having like orientation which are suspended on a pair of parallel strips 73, 75 which strips are spaced a distance apart, said rivets being held ready for insertion into the conveying tube 72. The separation of the strips 73, 75 is greater than the diameter of the rivet shaft and smaller than the diameter of the rivet head. The inlet opening of the conveying tube 72 is disposed directed transversely to the row of rivets, laterally of the forwardmost rivet 77. The outlet opening of a compressed air line 79 is disposed opposite to said inlet opening of the conveying tube 72. The strip 73 nearer to the opening of the tube 72 is eliminated over a length corresponding to the shaft diameter of the rivet 77. The air line 79 is connected to a compressed air source (e.g. source 287 connected via a tube 286 and a valve 289—see FIG. 17, described infra), and bears a valve which can open the line 79 for a short period to release a pulse of compressed air.

A control system (e.g. the sequential controller 281 shown in FIG. 17) is provided for the device, which supplies the necessary actuating pulses to the above-mentioned drives (piston-and-cylinder units) and the valve (e.g. 289) at the appropriate times.

The described apparatus operates as follows:

A rivet 1 is delivered by the conveying tube 72 and passes over the receiving strips 76, 78 between the claws 82, 84, 86 which are in ready status. The rivet (2) is transferred out of the receiving station and into the holding mechanism 40, by lowering of the plunger 90, with the swing arm 30 in the receiving position (as determined by suitable sensors), and said swing arm 30 is pressed against the underside of the claws 82, 84, 86 by appropriate actuation of the piston-and-cylinder unit 56. With a rivet disposed in the holder 40, which position defines an "intermediate position" of the rivet, the drives coupled to the levers 50 and 27 are sent actuating pulses, whereby the shaft 26, 28 with swing arm 30 swings away from the receiving position and into the delivery position, if it is determined (by suitable sensors) that the down-holder 16 is in its upper dead point position. When this condition is satisfied, the piston-and-cylinder unit 56 receives a pulse from the aforementioned control system, causing the piston of unit 56 to execute an outward stroke, whereby the shaft piece 28 is moved axially upward by the distance d. The distance d is defined by the vertical distance between the top surface of a rivet head in the transfer position in the holding mechanism 40 and the top surface of a rivet head in the holding device 60.

An upward excursion of the swing-arm 30 by the distance d carries the rivet 5 into the holding device 60 between the spheres 62, 64 (as shown at 6 in FIG. 1). Then by a reverse control signal to the piston-and-cylinder unit 56 the swing arm 30 is lowered by the distance d and is returned to the receiving position (FIG. 2). Following this, the down-holder 16 with holding device 60 moves downward to its lower dead point position, after which the press-bar 18 is acted on by a separate drive in the crown 12 and drives the rivet 6 out of the holding device 60 and onto the forming support 15, resulting in riveting of the sheet metal workpieces disposed there, in known fashion.

The control system detects the return of the swing arm 30 into the receiving position, and sends an actuating pulse to the valve in compressed air line 79. The resulting compressed air pulse drives the forwardmost rivet 77 from the strips 73, 75 into the conveying tube 72 through which the rivet is blown into the receiving station 70, thereby providing a new rivet which is ready for the rivet-driving apparatus 10.

Figure 6:
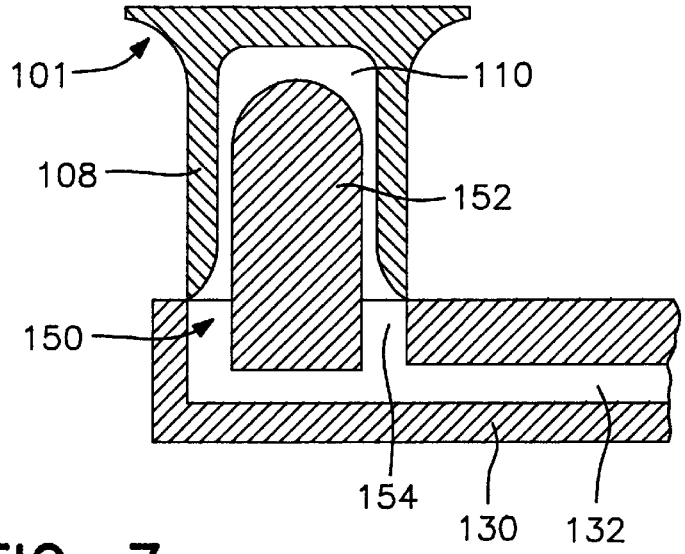
FIGS. 6—10 are additional embodiments of the intermediate holding station and/or receiving station.

In another embodiment of the swing arm 30, illustrated in FIG. 6, the swing arm 130 (shown only partially) has a central longitudinal channel 132 connected to a source of under pressure, i.e. vacuum pressure (not shown). Channel 132 is open in order to provide holding means 150 for the fastener, said holding means being in the form of a ring-shaped channel 154 surrounding a dome-shaped piece 152. The height and width of the dome 152 are slightly smaller than the void space 110 interior to the rivet shaft 108. The dome 142 is fixed to the swing arm 130 by radial crossarms (not shown). When a rivet 101 is released by the claws 82, 84, 86 and the holding means 140 on swing arm 130 are disposed below the rivet 101 which has been held by said claws, wherein said holding means are disposed in alignment with axis 92, the said released rivet falls onto the dome 142 and is held by means of the vacuum pressure in channel 132. When the hollow rivet 101 is transferred from this intermediate position to the holding device 60, the vacuum pressure in channel 132 is relaxed, enabling reliable transfer of the rivet 101 from the swing arm 130 to the holding device 60.

Figure 7:
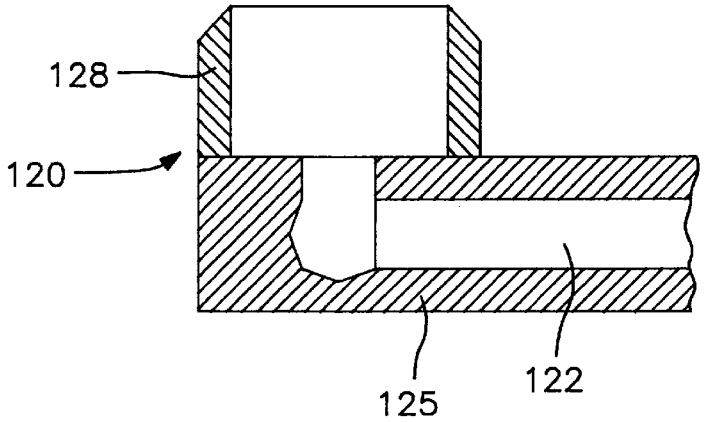

As shown in FIG. 7, the dome-shaped piece 142 of FIG. 6 may be generally replaced by an open sleeve 128 on a holding device 120 on a swing arm 125, wherein sleeve 128 is disposed over the opening of a vacuum pressure channel 122 in arm 125, wherein the open width of sleeve 128 is slightly greater than the outer diameter of the shaft of a rivet. The rivet may be hollow or solid. When the rivet is transferred from the claws 82, 84, 86 to the holding device 120, the shaft of the rivet is sucked into the interior of the sleeve 128, and the rivet is held on the holding device 120 during the swinging movement of the swing arm 125.

Figure 8:
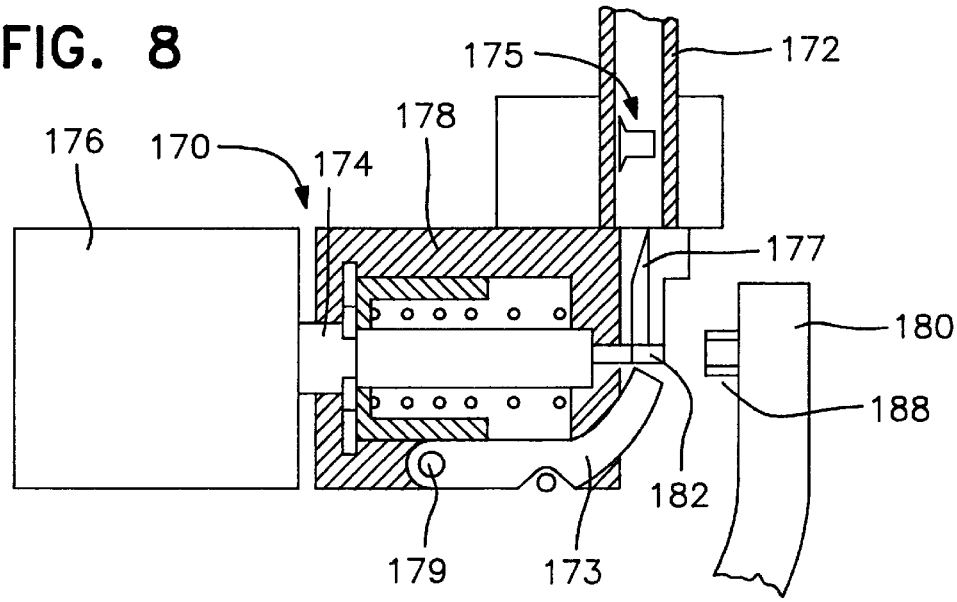

A slightly different embodiment of the receiving station 70 of FIG. 2 is illustrated in FIG. 8, in the form of a receiving station 170. The piston 174 of a piston-and-cylinder device 176 bears a bushing 178 which is disposed so as to be guidable in linear movement ahead of a block 171 which accommodates a tube end 172. The cylinder unit 176 and block 171 are fixed to a frame (not shown). Guide strips 177 are disposed downstream of the opening of the tube 172 which tube penetrates the block 171. These strips 177 engage the head of a rivet 175 arriving through the tube 172, and they accommodate the shaft of rivet 175 between them. As in the above-described exemplary embodiments, the rivet 175 is moved between claws 182 ahead of the end face of the bushing 178; as described the claws undercuttingly engage the head of the rivet 175. When the rivet moves between the claws 182 it actuates a contact arm 173 which is swingably mounted (via pivot 179) on bushing 178. This actuation results in delivery of a pressurized medium to cylinder device 176, via a device connected to the sequential control system, wherein the piston 174 and the bushing 178 fixed thereto are moved toward the swing arm 180 which bears a sleeve 188 and is disposed in the receiving position. As in the exemplary embodiments according to FIGS. 6 and 7, the swing arm 180 may have a central under pressure channel (not shown), so that the rightward advancing of the bushing 178 will cause the shaft of the rivet to penetrate into the sleeve 188. Then the claws 182 are swung out, to release the rivet; due to the vacuum pressure, the rivet becomes fixed on the swing arm. The bushing 178 is then returned to its starting position illustrated in FIG. 8.

Figure 9:
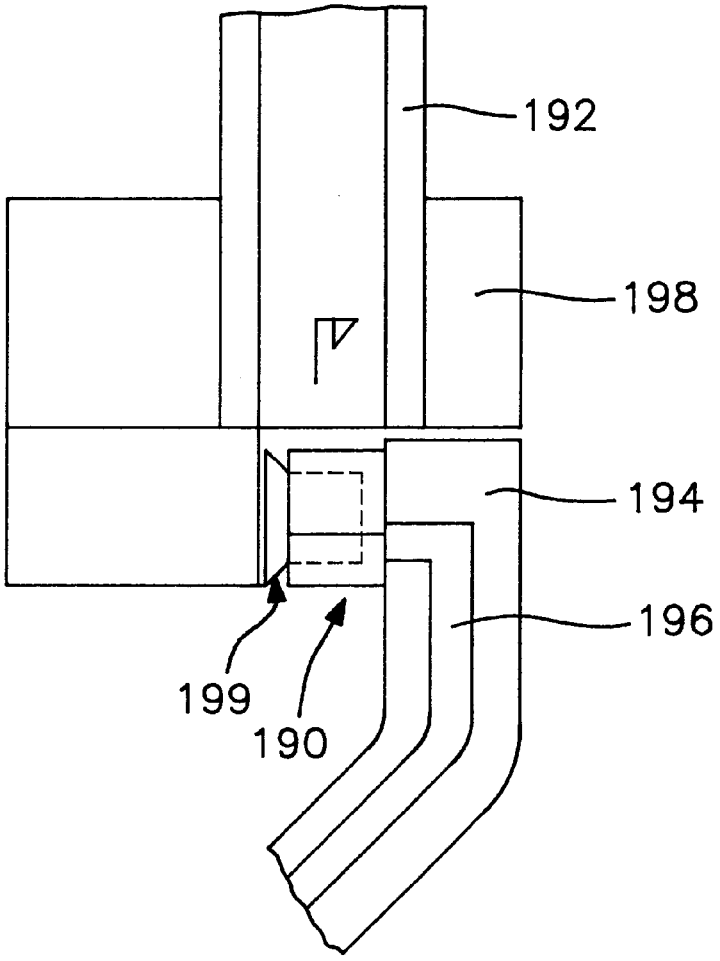
Figure 10:
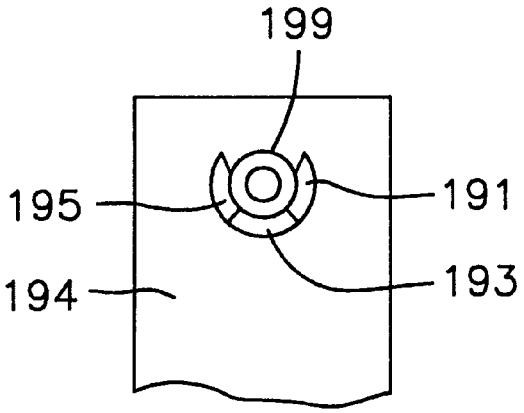

In the exemplary embodiment illustrated in FIGS. 9 and 10, a tube 192 opens out immediately ahead of a holding device 190 which is fixed to a swing arm 194 having a vacuum pressure channel 196. The holding device 190 has three segments 191, 193, 195 which are disposed in succession around the periphery of an arc, wherein the gap between the two outer segments 191, 195 is sufficient to allow passage of the shaft of a rivet 199 (FIG. 10). When the swing arm 194 is disposed downstream of the opening of the tube 192 in block 198, as shown in FIG. 9, the rivet 199 which has been conveyed forward by pressurized air in tube 192 is expressed directly into the holding device 190, such that the head of the rivet 199 rests on the segments 191, 193, 195 and the shaft is gripped between said segments. The rivet 199 is held in the holding device 190 by means of vacuum pressure applied from channel 196 which opens out between the segments 191, 193, 195.

Figure 12:
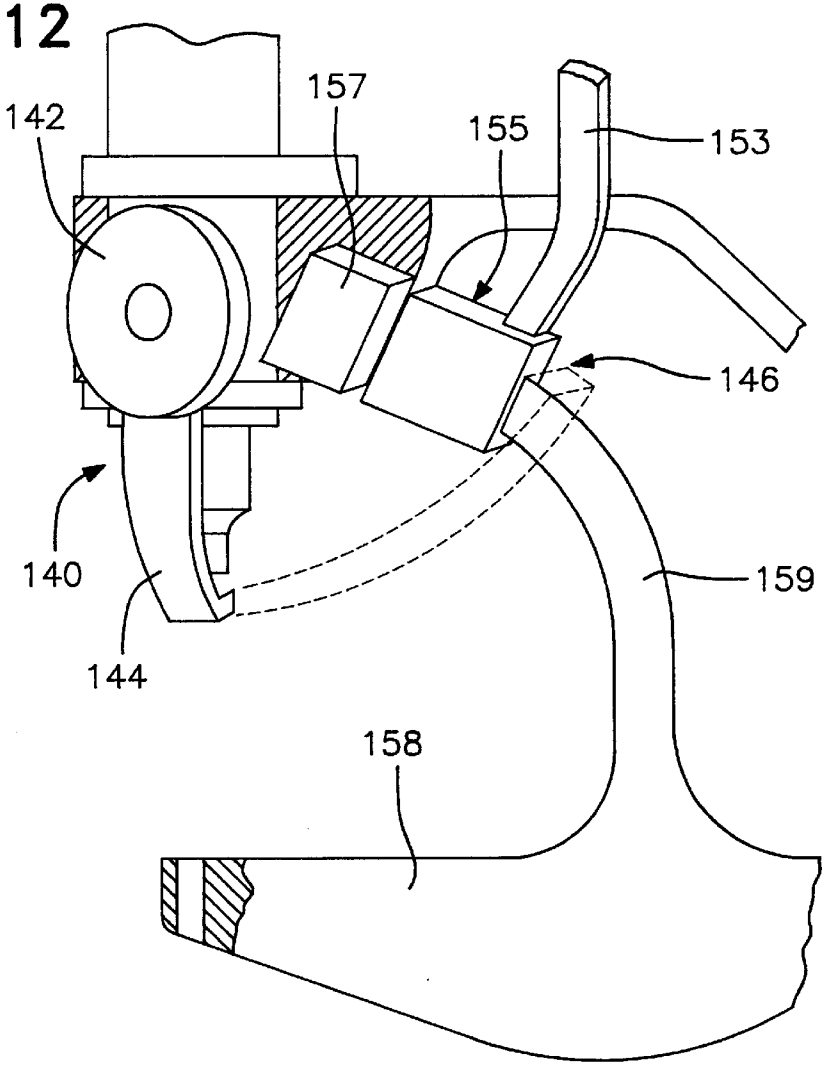
FIGS. 11—13 are additional embodiments of the transfer mechanism (set-up device)
Figure 11:
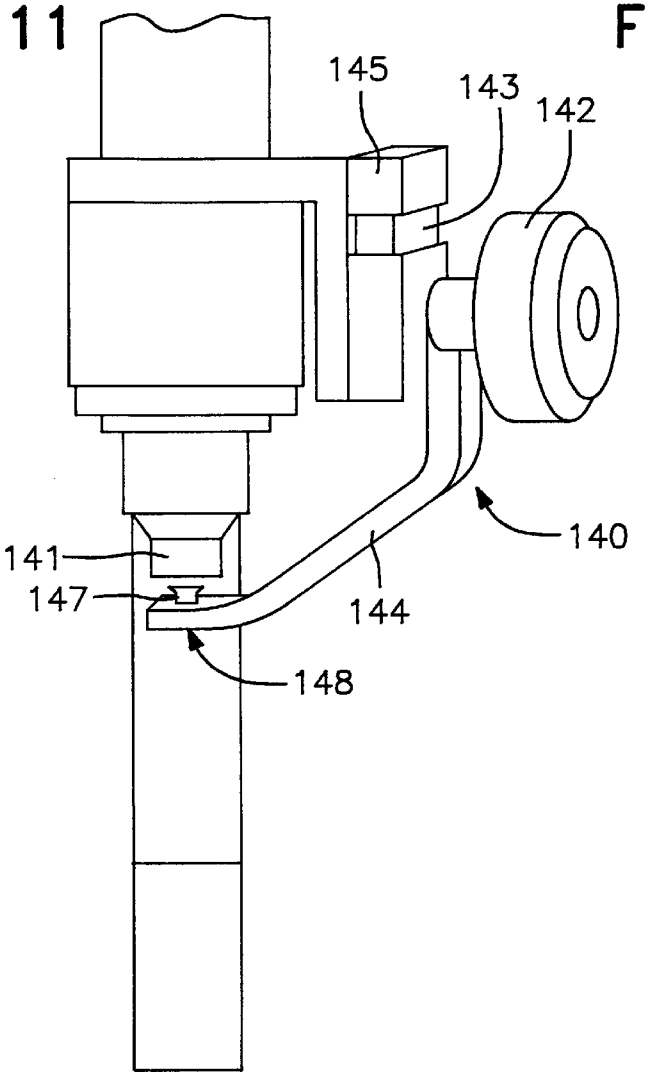

FIGS. 11 and 12 illustrate a transfer mechanism (set-up device) 140 which has a rotator cylinder device 142 and a swing arm 144. Rotator 142 can rotate arm 144 from the receiving station 146 to the delivery station 148 ahead of a holding device provided in an orifice piece or mouth piece 141, in the manner described supra (with regard to swing arm 30 illustrated in FIGS. 1–2). The rotator 142 is fixed to the piston 143 of a lifting piston-and-cylinder unit 145 which unit is fixed to the driving machine. Rivets such as rivet 147 are conveyed via a tube 153 to a receiving station 155 which may be of a type described hereinabove. The cylinder 157 of the receiving station 155 is mounted on the driving machine, and the station 155 itself may be additionally supported by a special support member 159 of the C-frame 158. The advantage of a transfer mechanism of the type of mechanism 140 is that the moving parts are relatively small and the entire transfer structure is compact.

Figure 13:
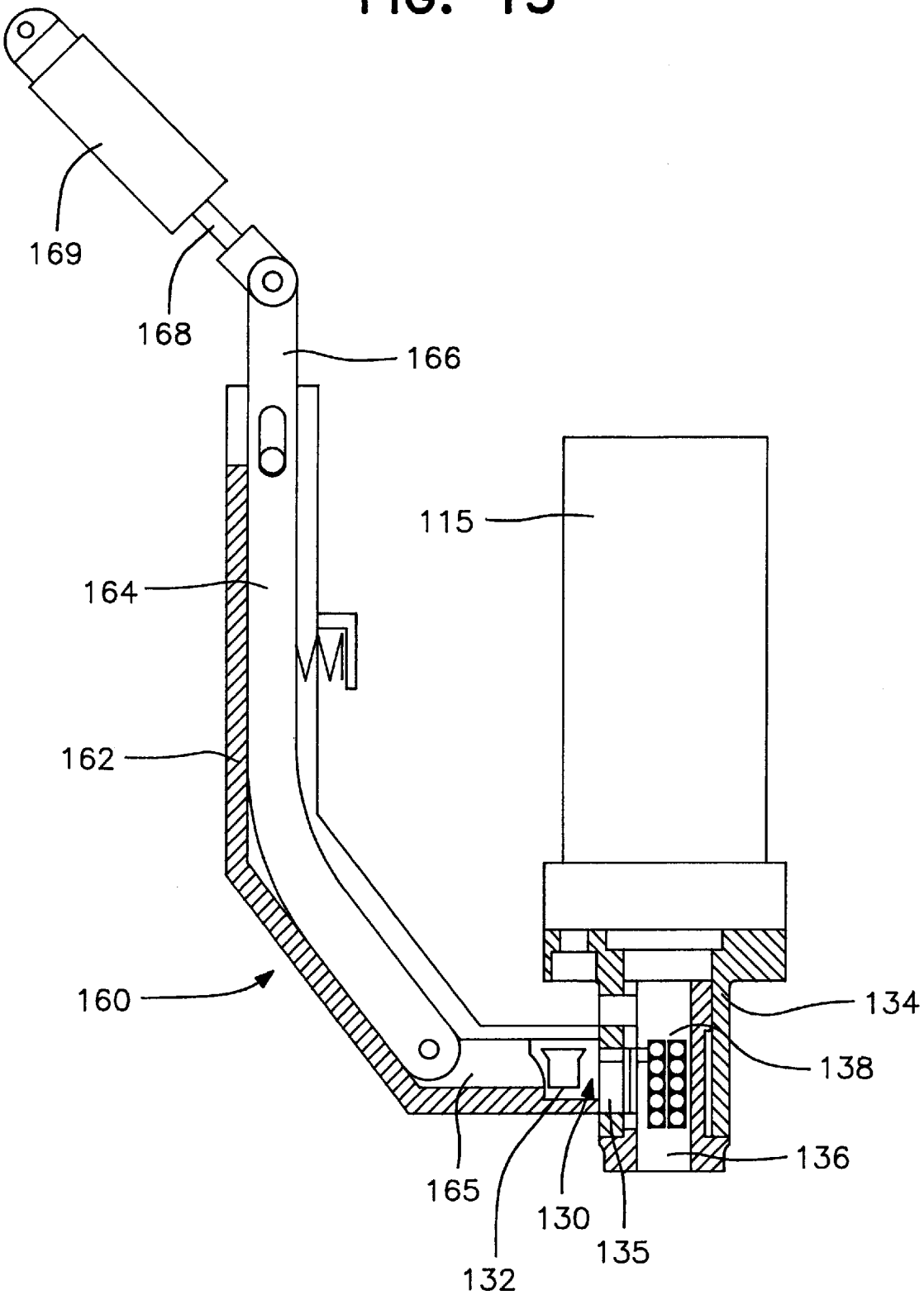

FIG. 13 illustrates a transfer mechanism 160 having a swing arm 162 with a two-part push member 164, 165. The end 166 of member 164 which extends out of the swing arm 162 on the side distal from the driving machine 115 is connected to the plunger 168 of a piston-and-cylinder unit 169. The short element 165 of the push member 164, 165 is associated with a receiver 130 formed from the opening of the swing arm 162 and a contour in said short element 165 which contour suitably matches the configuration of a rivet 132. The swing arm 162 can be swung back and forth between a receiving position (not shown) and the delivery position shown in FIG. 13. In said delivery position the receiver 130 is disposed ahead of a lateral opening in the orifice piece or mouth piece 134 of the driving machine 115. A plurality of vertical rows of spheres (according to Eur. 567,240) are distributed circumferentially around the interior of the walls of the central channel 136 in machine 115, wherewith the individual spheres in each vertical row 138 of spheres are vertically (axially) movable along a respective guideway (not shown). A rivet 132 previously transferred to the swing arm 162 when said arm was disposed at the receiving station is pushed laterally through the opening 135 into the orifice piece 134 in the region between the rows 138 of spheres, by delivering a pulse of pressurized medium to the cylinder unit 169 which expresses the plunger 168 which in turn advances the push member elements 164, 165 in the swing arm 162. Consequently, the rivet 132 is slid laterally through the lateral opening 135, by means of the frontmost element 165 of the push member, and comes to be disposed in the rows 138 of spheres in the orifice piece 134.

Figure 14:
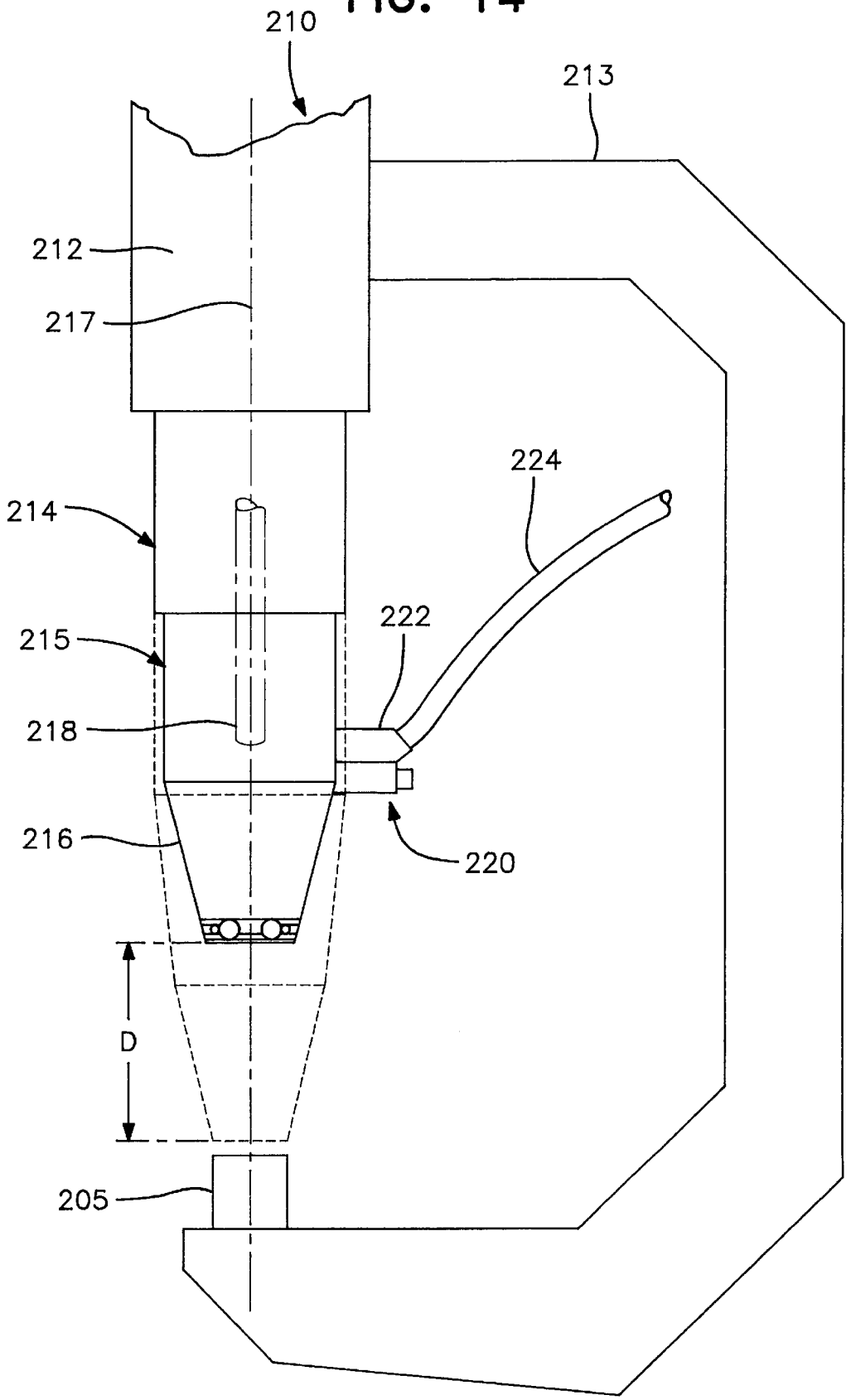
FIG. 14 is a schematic representation of a second embodiment of a riveting apparatus equipped with the features of the invention.

According to another exemplary embodiment of the invention (FIGS. 14–15), a fastener-driving apparatus, designated generally 210, may be used to drive rivets 202 for riveting two workpieces (not shown). The rivet 202 is top-heavy, and the length of its shaft 208 is less than the diameter of its head 207.

The driving apparatus 210 has a fixed crown 212 from which a reducing piece 214 can be driven back and forth through a downward excursion D. Reducing piece 214 accommodates an elongated press-bar or hammer 218 in its axial center region. An intermediate piece 215 is connected to the lower part of the reducing piece 214. A down-holding appliance 216 is borne on intermediate piece 215. The lower dead point of the assembly comprised of the reducing piece 214, intermediate piece 215, and down-holder 216 is shown with dashed lines in FIG. 14.

A so-called C-frame 213 is affixed to the crown 212 of the driving apparatus 210. The C-frame extends in a large arc from the crown 212 to a position below the lower dead point of the aforesaid assembly, and is there provided with a forming support 205 directed toward the down-holder 216 along the axis 217 thereof.

When two sheet metal workpieces to be riveted are placed on the forming support 205, this triggers an operating stroke of the advancing assembly 214, 215, 216, to the lower dead point, following which the press-bar 218 is subjected to a forcible axial impulse which drives the set-up rivet ahead of it into the workpieces which are to be fastened. The press-bar 218 and advancing assembly are then returned to their upper rest positions. The direction of driving is along the axis (center line) 217.

The down-holder 216 has a generally cylindrical shape (FIG. 15), with the upper part comprised of a cylinder 211, with the rivet-feed fixture 220 (FIG. 14) incorporated therein. The cylinder 211 has at least one slot 262 parallel to the central axis 217, which slot is engaged by the head 264 of a screw which is held fixed in the lower part 251 of the intermediate piece 215. The axial length of slot 262 is determined from the distance d and the outer diameter of the head 264. Thus the slot serves to limit the axial mobility of the down-holder 216 to an excursion d relative to intermediate piece 215.

The rivet-feed fixture 220 serves to set up individual rivets which are to be driven by the press-bar. Fixture 220 is attached to the down-holder 216 by means not shown. The fixture is comprised of a solid block 222 which is inserted laterally in cylinder 211 and which extends to a guide channel for the press-bar 218. Opposite ends 252, 253 of the cylindrical structure 211 penetrate in the circumferential direction into corresponding recesses 254, 256 in block 222. Intermediate piece 215 is terminated in a detent surface 255 above block 222. In the rest state, a compression spring 260 serves to maintain a distance d between the detent surface 255 and the opposing surface 257 on the fixture 220. The lower end of spring 260 is held in a blind bore 259 in block 222, and the upper end is held in a corresponding blind bore 258 in the intermediate piece 215; the two bores 259, 258 are mutually aligned.

Generally, the space surrounded by the cylindrical structure 211 and by the part of block 222 which is interior to structure 211 is filled by the lower part 251 of the intermediate piece 215, inwardly up to the guide channel for the press-bar 218. Accordingly, in the rest state a distance d separates the underside 285 of part 251 from a radially inwardly projecting ring-shaped shoulder 267 on the down-holder 216. This distance is maintained not only as a result of the action of the spring 260 but also as a result of the action of two other springs 292, 294 which are compressed between the underside 285 and the ring-shaped shoulder 267. If, during the common downward stroke of the intermediate piece 215 and the down-holder 216, the down-holder abuts against the sheet metal pieces on the forming support 205, the intermediate piece 215 will continue to move an additional distance d over the down-holder 216, until surface 255 abuts surface 257 of block 222, and underside 285 abuts ring-shaped shoulder 267.

Figure 16:
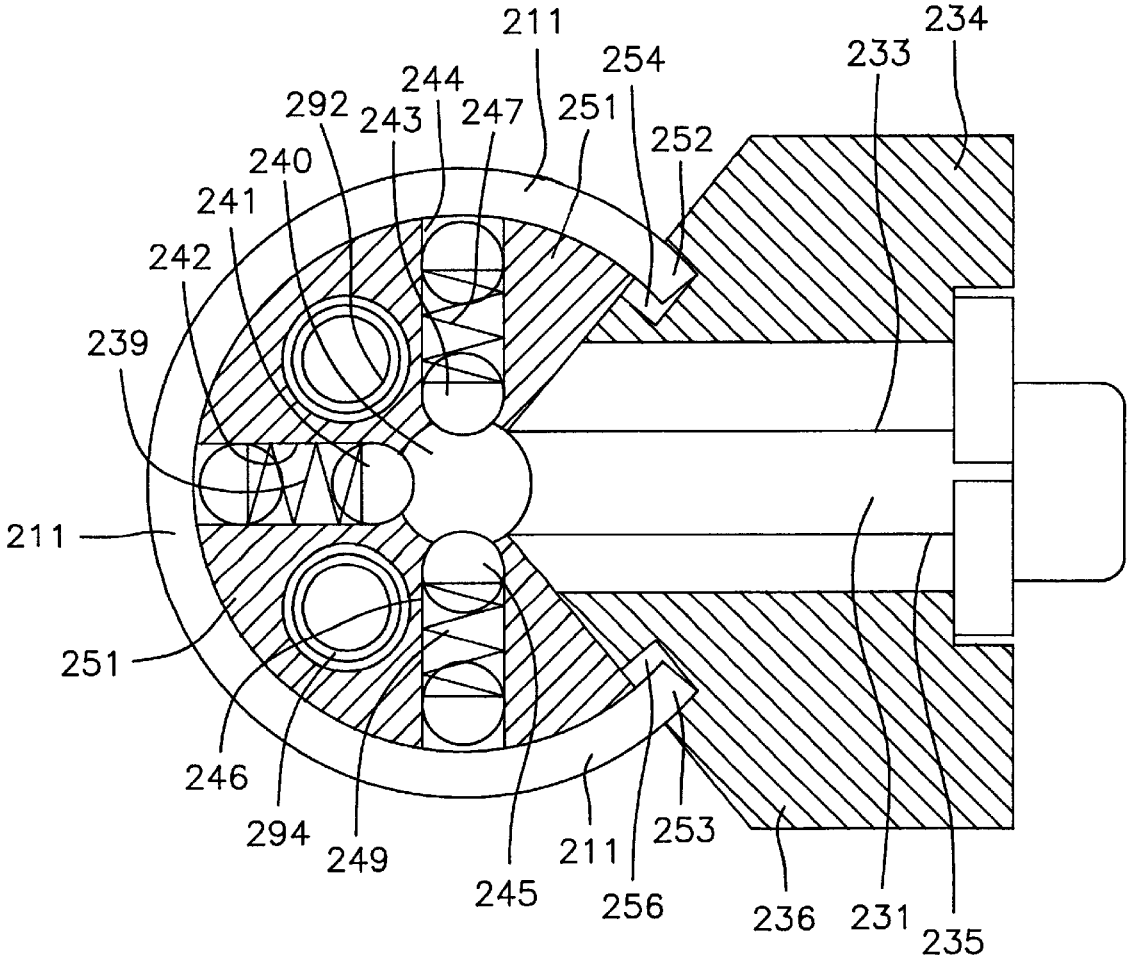
FIG. 16 is a cross section of the down-holding appliance according to FIG. 15, through the line III—III.

Lower part 251 has three radial bores 242, 244, 246 disposed in a plane 288 transverse to the center line and near the underside 285 of part 251. These bores are separated by successive 90° angles in the circumferential direction. They are closed off exteriorly by cylinder 211, and interiorly they narrow at the transition to the central channel 240. In each such radial bore 242, 244, 246 a steel sphere 241, 243, 245, respectively is pressed against the narrowing configuration by means of a radially acting compression spring 239, 247, 249. Accordingly, as seen in FIG. 16, a cup-shaped spherical segment of each sphere 241, 243, 245 projects into the central channel 240.

A flexible plastic tube 224 opens into an outer region of block 222. The shape of tube 224 is adapted to the contour of a rivet, so that each rivet conveyed by forced air maintains a prescribed orientation with respect to the center line of the tube during the transit of said rivet through the tube 224. The free end of tube 224 (FIG. 14) is connected to a compressed air source 287 and to the delivery channel 282 of an automatic aligning device or vibratory feeder, according to Ger. AS 42 39 683, said connections being via the intermediary of a slide-type transfer device 284.

The vibratory feeder described in said Ger. AS has a reservoir which can accommodate a large number of rivets in randomly arranged bulk. The vibratory feeder produces a row of aligned rivets from the mass of un-oriented rivets. Said aligned rivets are supplied accurately aligned at the outlet of said feeder, with, e.g., the rivet shaft downward and head upward. The two forwardmost such rivets are designated 204 and 206 in FIG. 17. The slide-type transfer device 284 is connected at its delivery side to the above-mentioned free end of tube 224. Transfer device 284 transports the forwardmost rivet from the delivery channel (or track) 282 to a position ahead of the opening of tube 224. On the opposite side of device 284 from tube 224 a compressed air line 286 is connected which leads to a compressed air source 287 via a valve 289 and a second compressed air line 288. An output signal line 285 supplies output signals from a sequential control unit 281 to the occluding element of valve 289, and a second output signal line 283 is connected from control unit 281 to transfer device 284.

Block 222 has an outer channel 226 inclined at c. 45° to the center line 217. The open width of channel 226 corresponds to the outer diameter of the tube 224, so that the tube 224 can be inserted into outer channel 226 as shown, and can be fixed there by suitable means (not shown). In the interior of block 222, outer channel 226 undergoes a transition to an inner channel 228 having the arc length of approximately ⅛ of a circle, so that inner channel 228 opens out transversely to the center line 217, said opening being into the side of the central channel 240 which constitutes an axial continuation of the above-mentioned guide channel for the press-bar 218. The altitude of said opening of channel 228 into central channel 240 is at a point slightly below the end face 232 of the press-bar 218; in the rest position, this altitude is the same as that of the middle bore 242 of the three radial bores 242, 244, 246 in the orifice part 251 of intermediate piece 215. Further, channel 228 opens out in alignment with and opposite to said middle bore 242.

Two guide strips 234, 236 disposed transversely to the center line 217 extend into the inner channel 228. These strips form a slot-shaped gap 231 between their neighboring edges 233, 235. This slot is only slightly wider than the outer diameter of the shaft 208 of a rivet 202 but is appreciably narrower than the diameter of the head 207. Guide strips 234 and 236 are mounted at an altitude in inner channel 228 which is at a distance from the upper edge 237 of channel 228 which distance is slightly greater than the axial extent of the head 207 of rivet 202. It is noted that the tube 224 and the inner channel 228 both have rectangular (or square) cross sections. Guide strips 234 and 236 serve to ensure that a rivet conveyed through tube 224 to inner channel 228 by compressed air lands with its head on the opposing edges of strips 234, 236 and with its shaft 208 hanging down through slot 231, as illustrated by rivet 202 in FIG. 15.

The lower part 266 of down-holder 216 has a throughgoing bore 268 with a diameter which is smaller than the free diameter of the space enclosed by the ring-shaped wall or cylindrical structure 211. The transition from the cylindrical structure 211 to the lower part 266 has a radially projecting ring-shaped shoulder 267 surrounding a central opening of a diameter corresponding to that of central channel 240. Guide means (not shown) for a rivet are disposed in bore 268 below shoulder 267; these may be, e.g., in the nature of guide means for a fastener delivery tube described in Eur. Pat. App. 567,240.

Figure 15:
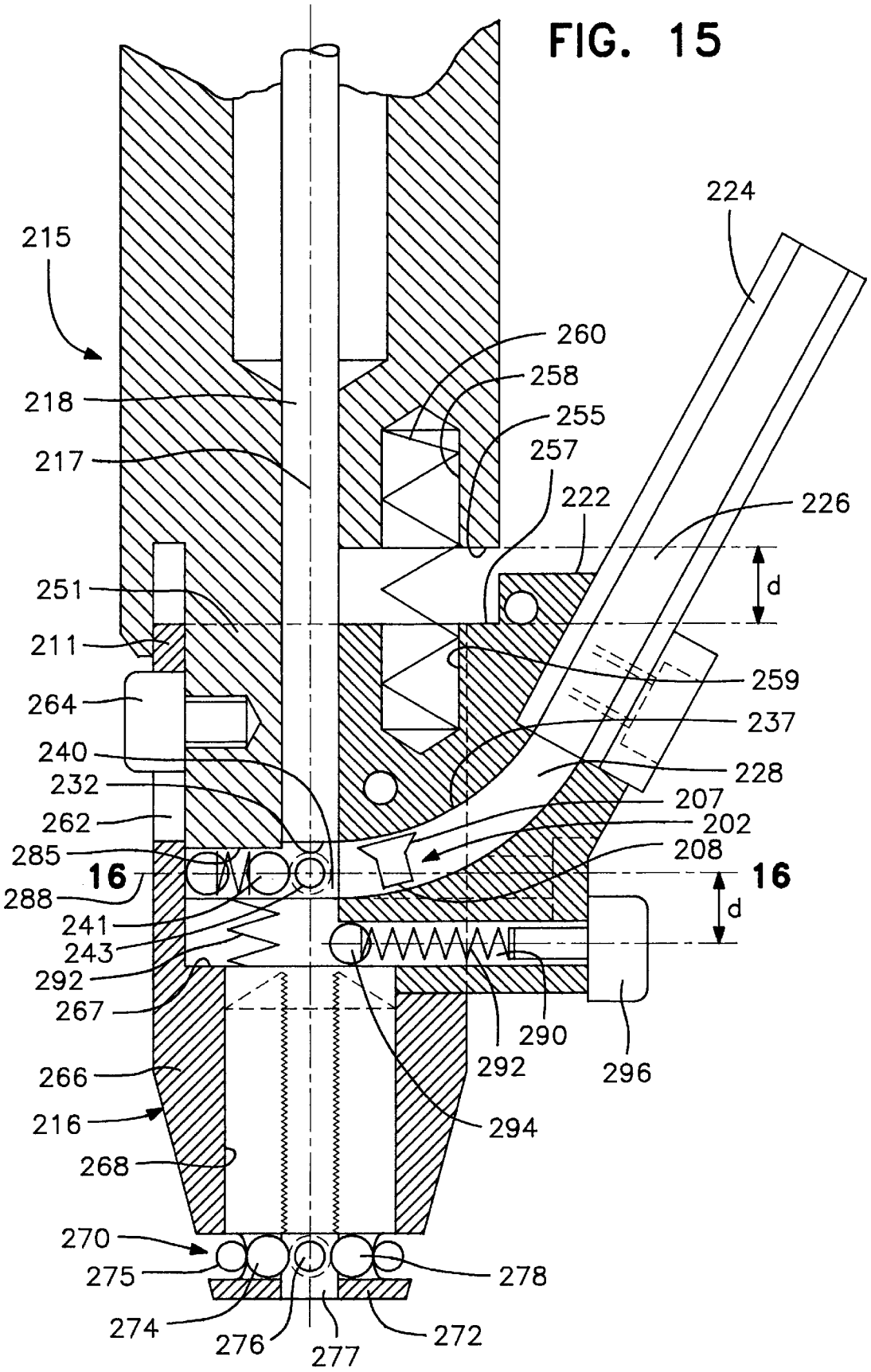
FIG. 15 is an enlarged axial cross section of the down-holding appliance of the riveting apparatus according to FIG. 14.

A foot structure 270 is formed on the lower, free end of down-holder 216, comprised of a foot plate 272 and a ring of four spheres (three of which, 274, 276, and 278, are rendered in FIG. 15). Foot 270 has a throughgoing channel 277 aligned with the central channel 240. The four spheres 274, 276, 278 are each held by means of an O-ring 275 so as to be radially elastically movable in respective radial bores wherein a cup-shaped spherical segment of each sphere projects into the channel 277. O-ring 275 surrounds all four spheres 274, 276, 278.

A radial bore 290 is present in block 222 below inner channel 228, which bore bears a sphere 294 which is radially inwardly spring-loaded by a spring 292 such that a cup-shaped spherical segment of said sphere projects into central channel 240. The position of radial bore 290 is chosen such that the center line 286 of bore 290 is a distance d below the midplane 288 of the radial channels (242, 244, 246).

During the above-mentioned downward stroke of the intermediate piece 215 and down-holder 216, the rivet which is being transported via tube 224 and inner channel 228 to a position ahead of the end face 232 of press-bar 218 is delivered to a position in which it is held against the projecting spherical segments of the three spheres 241, 243, 245 and by means of the compressed air pulse applied against the exposed side of the rivet. When the down-holder 216 is moved against the sheet metal pieces which are to be fastened, the intermediate piece 215 will continue to move an additional distance d over the down-holder 216, wherein the rivet will be held additionally by the sphere 294 projecting below the rivet head. Immediately following the downward stroke of intermediate piece 215 through the distance d, the driving impulse for the press-bar 218 will be triggered. The press-bar will thus drive the rivet between the four spheres 241, 243, 245, 294 and through the guide means provided in channel 268, and finally through the bottommost four spheres 274, 276, 278 and into the sheet metal workpieces. After the riveting is completed, the intermediate piece 215 and down-holder 216 are raised again to the rest position shown in FIG. 15. Then a new rivet can be expelled into the central channel 240.

Figure 18:
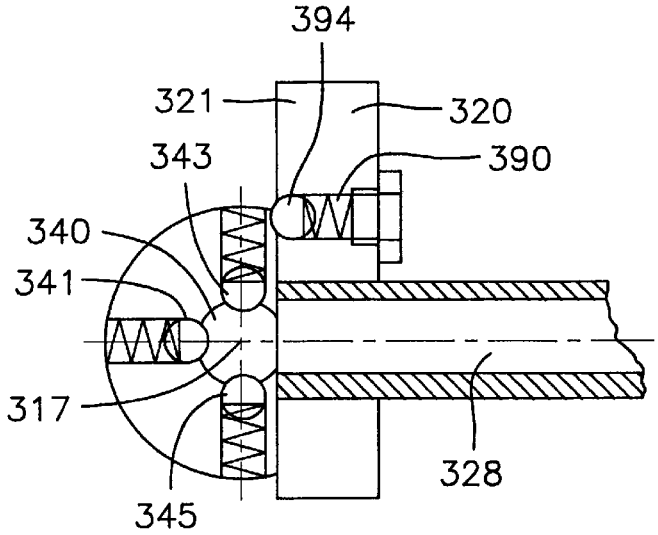
FIGS. 18–21 are schematic representations of additional embodiments of the transfer mechanism (set-up device).

The described invention can be varied in numerous ways without departing from the scope of the inventive concept. For example, the inner end of the inner channel 328 (FIG. 18), which channel generally corresponds to inner channel 228 of FIG. 15, may be held in a sliding member 320 which can be moved transversely to the axis 317 defining the fastener driving direction, which movement is simultaneously parallel to the plane of the inwardly projecting spheres (341, 343, 345). The movement of sliding member 320 is powered by a piston-and-cylinder unit (not shown). A bore 390 is provided in sliding member 320, near the inner channel 328, wherewith a spring-loaded sphere 394 is disposed at the inner end of said channel, which sphere 394 corresponds to sphere 294 (on the right side of FIG. 15). When one of the earlier-mentioned sensors determines that a rivet (not shown in FIG. 18) has advanced in central channel 340 and has come to abut the projecting cup-shaped spherical segments of spheres 343, 341, 345, the piston-and-cylinder drive means for the sliding member 320 are actuated, wherein said member 320 is moved laterally (downwardly in FIG. 18) until sphere 394 is disposed facing the lateral opening in the central channel 340. Under these conditions, spheres 343, 341, 345, and 394 are arrayed in a plane, and form a holding device for the rivet.

It goes without saying that it is also possible to have the sliding member 320 configured such that it may be moved into coordination with the central opening 340 by vertical movement, thus movement parallel to the fastener driving direction 317, said movement of member 320 being powered by the associated piston-and-cylinder drive means.

Figure 19:
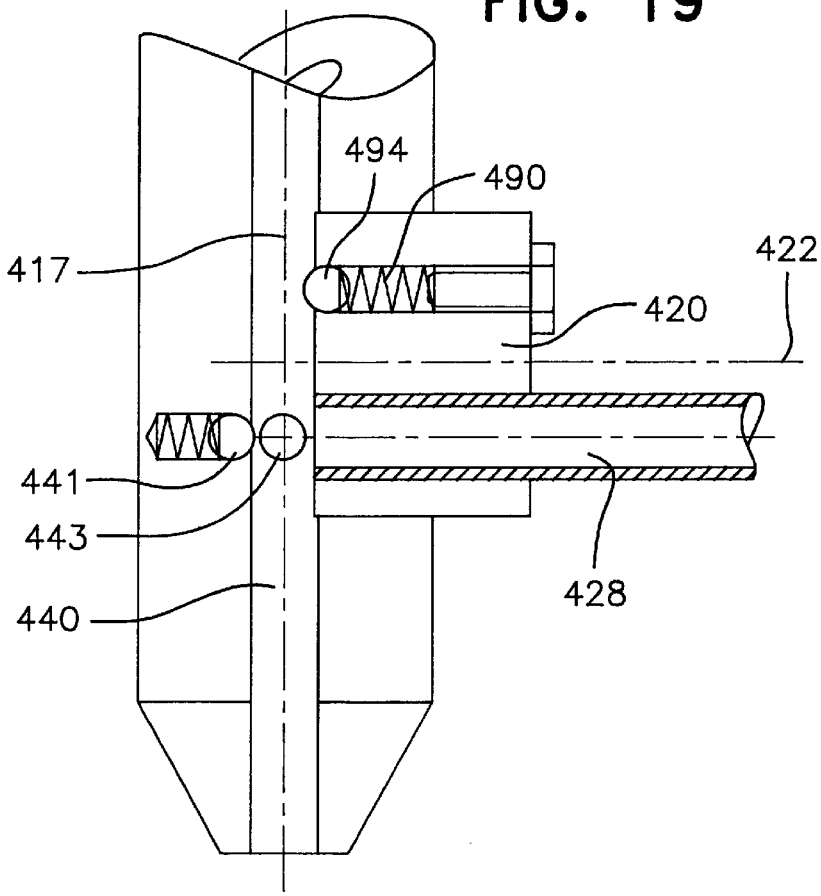

According to FIG. 19, in another embodiment the sliding member 320 is replaced by a drum 420 in which the inner channel 428 extends radially at the altitude of the plane of the spheres (443, 441). Drum 420 is rotatable around an axis 422 which is perpendicular to the fastener driving axis 417, by means of a rotator cylinder device or the like (not shown). A bore 490 bearing a spring-loaded sphere 494 at its inner end is provided in the drum 420, wherein the center line of bore 490 is disposed at a distance away from the rotational axis 422 which distance equals the distance between axis 422 and the center line of the inner channel 428 which center line is disposed in the midplane of the spheres (443, 441, 445). When a rivet has come to abut the spheres (443, 441), a sensor (not shown) senses this and, via control unit 281, triggers a rotation of drum 420 by an angle which brings sphere 494 into the plane of the spheres (443, 441), to complete formation of the holding device.

Figure 20:
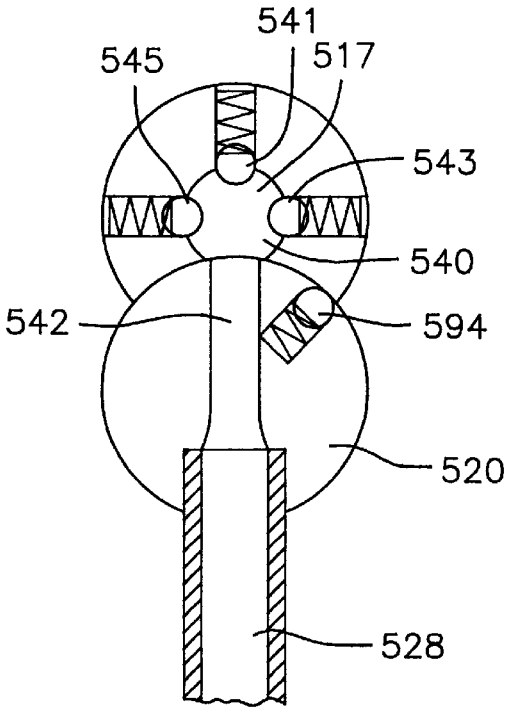
Figure 21:
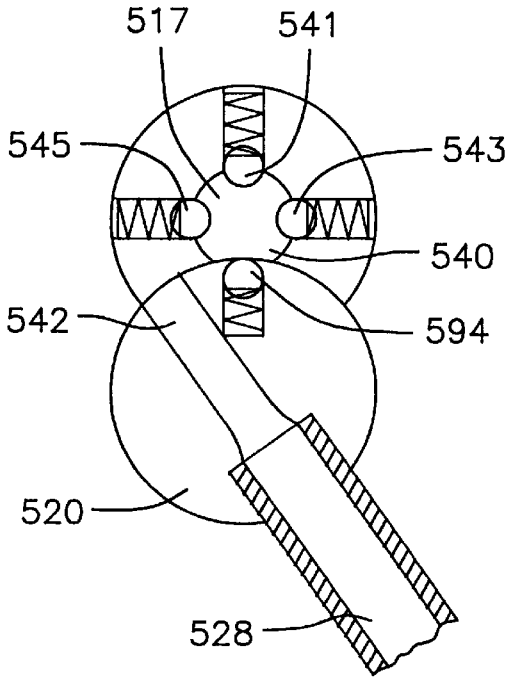

According to the embodiment illustrated in FIGS. 20 and 21, the inner channel 528 and the spring-loaded sphere 594 are disposed on a disk 520 which rotates around an axis parallel to the driving direction 517 by means of a rotational drive unit (not shown). This disk is disposed at the altitude of the plane of the spheres 543, 541, 545. With progression toward the central channel 540, inner channel 528 undergoes a transition to a channel 542 which is adapted to the configuration of the shaft and head of the rivet and which opens out into central channel 540 at the altitude of said spheres (543, 541, 545).

FIG. 20 shows the position of disc 520 preparatory to injection of a rivet to the aggregation formed by the spheres (543, 541, 545), and FIG. 21 shows the position of disc 520 after subsequent rotation through an angle such that the cup-shaped forward segment of spring-loaded sphere 594 projects into central channel 540, and channel 542 has been moved away.

All of these modifications (FIGS. 18–21) have the advantage over the inventive exemplary embodiments previously described that a separate excursion by the distance d of the intermediate piece 215 with respect to the down-holder 216 is obviated. As a result, the down-holder 216 i.e. the final down-movement in the set-up process can be shortened by the distance d i.e. by the additional controlled stroke of intermediate piece 215 through distance d, which facilitates positioning and guiding of the set-up rivet by the press-bar during the rivet-driving process.

We claim:

1. An apparatus for setting up fastener elements having a shaft and a head, wherein the shaft has a length equal to or less than a diameter of the head, said setting up being in front of a press-bar or hammer of a fastener-driving machine which press-bar or hammer is engageable with the head of the fastener elements, the apparatus comprising a transfer mechanism for transporting fastener elements in succession by a flow of a medium, into an intermediate position in the vicinity of said press-bar or hammer, wherein a radially elastic holding device is disposed in the fastener-driving machine, which holding device is movable with the press-bar or hammer and grips the fastener element adjacent the head and holds the head in an axial orientation with respect to said press-bar or hammer at a location in front of said press-bar or hammer, said transfer mechanism provided with transfer means for transferring a transported fastener element to said holding device.

2. The apparatus according to claim 1 wherein said transfer means acts on a fastener element which has been transported to the intermediate position, whereby said transfer means transfers said element into the holding device from below, namely in a direction counter to a driving direction.

3. The apparatus according to claim 1 wherein the fastener element is held temporarily in the intermediate position in front of the press-bar or hammer, and subsequently said fastener element is transferred into the holding device during driving of said press-bar or hammer.

4. The apparatus according to claim 1 wherein the holding device has a ring of spheres which spheres are held radially elastically in a mouth piece surrounding the press-bar or hammer in the driving apparatus, wherein during driving of said press-bar or hammer, the spheres are moved along with the press-bar or hammer in a driving direction.

5. The apparatus according to claim 1 wherein said transfer means comprises a swing arm which is swingable between a receiving/holding position and a delivery position for a fastener element.

6. The apparatus according to claim 1 wherein the transfer mechanism comprises a receiving station for temporarily holding a fastener element in alignment with an intermediate holding station.

7. The apparatus according to claim 6 wherein the receiving station comprises a plurality of claws mutually separated in a circumferential direction and radially elastically cooperating, which claws can engage a fastener element below its head.

8. The apparatus according to claim 6 further comprising a piston-and-cylinder unit for transferring a fastener element held in the receiving station to the holding device on a swing arm.

9. The apparatus according to claim 6 further comprising a plurality of radially elastic segments provided in the intermediate holding station, for gripping the shaft of the fastening element, which segments are mutually separated in a circumferential direction.

10. The apparatus according to claim 8 wherein the swing arm has a vacuum pressure channel for holding a fastening element fixed at the intermediate holding station with the aid of vacuum pressure.

11. The apparatus according to claim 8 further comprising a dome-shaped piece provided in the intermediate holding station, which piece is capable of penetrating into a hollow shaft of a fastening element, holds such fastening elements, said piece fixed to the swing arm.

12. The apparatus according to claim 8 further comprising a sleeve provided at the intermediate holding station on the swing arm, wherewith a width of an opening in the sleeve is slightly greater than a diameter of the shaft of the fastening element.

13. The apparatus according to claim 6 further comprising a linearly slidable bushing provided in the receiving station, which bushing is disposed transversely to a direction of propulsion of a fastening element, and has claws for temporarily holding a fastening element fixed such that the fastening element is oriented toward the intermediate holding station on the swing arm.

14. The apparatus according to claim 13 wherein a plurality of segments are provided on the intermediate holding station on the swing arm, which segments include between themselves an opening which accommodates the shaft of a fastening element.

15. The apparatus according to claim 1 wherein the transfer mechanism comprises a swing arm which is swingable between a receiving/holding station and a delivery station, and which is driven by a rotator device.

16. The apparatus according to claim 15 wherein the rotator device is connected to a piston of a lifting cylinder, to insert a fastener element axially into the holding device from below the holding device.

17. The apparatus according to claim 15 further comprising a slidable push member provided in or on the swing arm, which push member is controllable via a piston-and-cylinder unit, wherein a forward end of said push member is profiled to accommodate a fastening element, to constitute a holding station, and inserts the fastening element into the holding device at the delivery station via a lateral opening in a mouth piece of a driving apparatus.

18. The apparatus according to claim 1 further comprising an inner channel provided with guide elements having an opening which opens out laterally into a mouth piece of a driving apparatus, said opening-out being at an altitude of a first part of the holding device, in front of the press-bar or hammer, which channel may be employed to deliver a fastening element in front of said press-bar or hammer.

19. The apparatus according to claim 18 wherein a second part of the holding device is disposed in the mouth piece, at an axial distance from the opening of the inner channel; and in that the mouth piece of the driving apparatus can be moved axially by a predetermined distance with respect to a down-holding device.

20. The apparatus according to claim 18 wherein said first part of the holding device, which first part is disposed at the altitude of an opening of the inner channel, is comprised of a plurality of radially elastic spheres having cup-shaped spherical segments which project into the path of the press-bar or hammer.

21. The apparatus according to claim 19 wherein after movement between the mouth piece and the down-holding device, the second part completes the holding device.

22. The apparatus according to claim 19 wherein the second part of the holding device and the mouth piece are both disposed on a sliding member which can be slid transversely to a driving direction, to complete the holding device.

23. The apparatus according to claim 19 wherein the mouth piece associated with the inner channel and the second part of the holding device are both disposed on a sliding member which can be moved linearly in a driving direction.

24. The apparatus according to claim 19 wherein the mouth piece associated with the inner channel and the second part of the holding device are both disposed on a rotatable drum which can be rotated around an axis disposed transversely to a driving direction, to complete the holding device.

25. The apparatus according to claim 19 wherein the mouth piece associated with the inner channel and the second part of the holding device are both disposed on a rotatable disc which is disposed at the altitude of the first part of the holding device and which disc can be rotated through a given angular excursion around an axis disposed parallel to a driving direction, to complete the holding device.

26. A device for feeding fastener elements having a shaft and a head, wherein a length of the shaft is equal to or less than a diameter of the head, to a tappet adapted to the head of a riveting machine, said device including a transfer mechanism which uses a fluid stream to feed one fastener element at a time into an intermediate position, the device comprising a radially elastic holding unit, capable of moving with the tappet, provided in the riveting machine the holding unit gripping the fastener element adjacent the head and holding the head in axial alignment directly against the tappet, and said transfer mechanism is provided with means for allowing a fed fastener element to enter the holding unit wherein one fastener element at a time is held in an intermediate position in front of the tappet and thereafter is transferred to the holding unit.

27. The device according to claim 26 wherein said holding unit includes a ball ring having balls held radially elastically within a mouth piece of the riveting machine which surrounds the tappet and which moves together with the tappet in a driving direction.

28. The device according to claim 27 wherein the mouth piece includes an internal channel provided with guiding elements which open in front of the tappet laterally at the level of a part of the holding unit of the riveting machine.

29. The device according to claim 28 wherein a further part of the holding unit is arranged within the mouth piece at an axially spaced distance to the opening of the internal channel and wherein the mouth piece is adapted to axially move relative to a holding-down device of the riveting machine for a predetermined distance.

30. The device according to claim 29 wherein the part of the holding unit provided at the level of the opening of the internal channel comprises a plurality of radially elastic balls, the exteriors of which extend into the path of the tappet.

31. The device according to claim 30 wherein said further part is arranged in the mouth piece after execution of the relative motion between the mouth piece and the holding-down device.

32. The device according to claim 31 wherein said further part of the holding unit and the mouth piece of the internal channel are arranged upon a pusher adapted to be shifted transversely to the direction of fastening.

33. The device according to claim 32 wherein said mouth piece of the internal channel and the further part of the holding unit are arranged upon a pusher adapted to be moved linearly to the fastening direction.

34. The device according to claim 33 wherein said mouth piece of the internal channel and the further part of the holding unit are arranged upon a rotatable turret adapted to be rotated about an axis transversely to the feeding direction.

35. The device according to claim 34 wherein said mouth piece of the internal channel and the further part of the holding unit are arranged upon a disk which is arranged at the level of said first part of the holding unit and which is adapted to be tilted about an axis which is parallel to the fastening direction.

* * * * *